United States Patent [19]

Heinen et al.

[11] Patent Number: 4,604,135

[45] Date of Patent: Aug. 5, 1986

[54] APPARATUS AND PROCESS FOR THE METALLURGICAL AFTERTREATMENT OF PREMELTED METALS

[75] Inventors: Karl-Heinz Heinen; Wolfgang Glitscher; Heinz Zörcher, all of Siegen, Fed. Rep. of Germany

[73] Assignee: Krupp Stahl AG, Bochum, Fed. Rep. of Germany

[21] Appl. No.: 738,918

[22] Filed: May 29, 1985

[30] Foreign Application Priority Data

Jul. 4, 1984 [DE] Fed. Rep. of Germany ..... 3424510

[51] Int. Cl.[4] ..... C21C 5/52

[52] U.S. Cl. ..... 373/60; 75/10.63; 75/10.66

[58] Field of Search ..... 75/10–12, 75/49

[56] References Cited

U.S. PATENT DOCUMENTS 3,729,307 4/1973 Plessing ..... 75/10 R 3,826,646 7/1974 Karlsson ..... 75/49

*Primary Examiner*—Peter D. Rosenberg

*Attorney, Agent, or Firm*—Sprung, Horn, Kramer & Woods

[57] ABSTRACT

The invention relates to an apparatus for the metallurgical aftertreatment of premelted metals, especially steel, consisting of a cylindrical ladle receiving the melt and closed by means of a cover and one or more electrodes passing through the cover and intended for heating the melt via electric arcs. The electrodes consist of metal castings, preferably of continuous-casting billets, which have a composition corresponding to the analysis of the metal melt. The invention also relates to a process for the aftertreatment of steel melts with very low carbon contents or with narrow carbon tolerances, in which electrodes consisting of a continuously cast low-carbon steel billets are used to heat the steel melt via electric arcs.

5 Claims, 1 Drawing Figure

APPARATUS AND PROCESS FOR THE METALLURGICAL AFTERTREATMENT OF PREMELTED METALS

BACKGROUND OF THE INVENTION

The invention relates to an apparatus for the metallurgical aftertreatment of premelted metals having a cylindrical ladle receiving the melt and closed by means of a cover and one or more electrodes passing through the cover and intended for heating the melt via electric arcs for producing steels with carbon contents below 0.02% or steels with narrow carbon tolerances, the steel being premelted in a smelting unit and subsequently being alloyed, rabbled and homogenized in an aftertreatment unit, the melt being heated via electric arcs between the melt and electrodes.

Apparatuses of this type have been part of the state of the art for a long time (thus, for example, GB periodical Steel Times, February 1978, pages 205–211). Their development arose from the desire, in the smelting of metals, to transfer substantially all the metallurgical work from the actual smelting unit to a subsequent treatment process. Only melting down would still be carried out in the smelting unit. Particularly in electric steel plants for the smelting of steel, this makes it possible to achieve considerable reductions in furnace time and consequently increased output. This results in so-called ladle metallurgy, referred to as secondary steelmaking in English-Language Literature, in which the metal from the premelting unit is run off into a ladle and subjected to aftertreatment in this. The main functions of after-treatment in steel production are:

steel alloying, establishing exact analyses, and analytical and temperature uniformity in the ladle.

To compensate for the temperature losses in the ladle, which are unavoidable during treatment and caused particularly by the addition of solid alloying metals and the scavenging of the steel melt by means of inert gases introduced via floor-level blowing bricks, the aftertreatment ladle is providing with a ladle-heating device, usually in the form of an electric-arc heating device, usually in the form of an electric-arc heating system. When heating of this type is used, a cover similar to that of an arc furnace is located above the ladle. By means of one or more electrodes (usually operated with alternating current) suspended on supporting arms and guided through a cover in electrodes guides, the steel melt can be heated via the electric arcs which are generated. Electric-arc heating can take place both under atmospheric pressure, in which case it is not necessary to seal the ladle off from the cover, and under a vacuum, in which case the ladle is closed so as to be vacuum-tight relative to the atmosphere and the electrodes are guided through the cover via vacuum gaskets. Round graphite electrodes which can be subjected to high current intensities and which generate an easily adjustable arc are used as electrodes according to the state of the art. They have a diameter of 300 to 500 mm, depending on the ladle size and the desired heating capacity. However, the electrodes are used up during operation as a result of oxidation with the atmosphere. Thus, as regards a ladle-heating system equipped with three 450-mm electrodes operated with alternating current, the electrode consumption is approximately 0.5 kg per ton of treated steel. At a price of approximately 6.--CM per kg of electrode, this corresponds to costs of approximately 150,000.--DM in the case of a monthly aftertreatment of approximately 50,000 tons of steel. Apart from these costs, it is not possible to use graphite electrodes in the aftertreatment of steels having very low carbon contents (0.02% C) or steels with a narrow range of analyses relating to the carbon content. The inert scavenging gas introduced into the melt through floor-level blowing bricks to homogenize the steel melt, especially after the addition of an alloying agent, makes the melt bubble in such a way that the electrodes normally "burning" just above the melt surface come in contact with the melt, and so much carbon enters the melt from the graphite material of the electrodes that the prescribed low or narrowly defined carbon contents are exceeded and the steel can therefore no longer be used for the intended purpose.

SUMMARY OF THE INVENTION

To avoid the disadvantages mentioned above, the present invention therefor proposes to provide an apparatus for metallurgical aftertreatment, of the type mentioned in the introduction, with electrodes consisting of metal castings. Advantageously, in this case the electrodes consist of continuously cast billets which have a composition corresponding to the analysis of the metal melt intended for aftertreatment. The cast structure of these continuous-casting billets, especially steel billets with a solidification structure which is dendritic in the core, allows such a metal electrode to be subjected to high currents with a high current density, but without the electrodes fusing quickly.

Thus, the burn-off of an electrode consisting of a continuous-casting billet of steel quality 42 Cr Mo 4, with a square cross-section of 175×175 mm, under a load of 40,000 amps and 250 volts for a period of 10 minutes, only amounts to approximately 0.5 m, corresponding to a fusion weight of 120 kg. When three electrodes connected to a 3-phase alternating current are used, it is therefore altogether 360 kg which are transferred as additional metal into the weight of the steel melt to undergo aftertreatment. Consequently, the fused material of the continuous-casting billet electrode is not lost, but increases the yield of aftertreated steel melt. Because the electrode burn-off is only very slight in relation to the total weight of the steel melt, there is generally no need to provide different steel qualities for the electrode in the melt, since the possibilities of analysis deviations are negligible.

However, where qualities with very high accuracy of analysis are concerned, it is recommended to select for the electrodes a steel composition which corresponds to the analysis of the aftertreated metal.

Remains of continuous-casting billets or remains of continuous-casting rounds are preferably used as metal electrodes. Insofar as these residues have a length insufficient for clamping them as electrodes, they can easily be welded together into a longer piece before being used as electrodes.

The invention is particularly suitable for the production of low-carbon steels or for the production of steel qualities with a narrowly defined carbon content.

The process according to the invention wherein the predetermined carbon content in the smelting unit is set and is maintained in the aftertreatment unit because elecrodes made of low-carbon steel are used to generate the electric arcs is advantageously carried out by means of electrodes consisting of continuously cast steel billets.

In any event, it is not necessary to ensure low carbon contents in the electrodes, but they should be below 0.5% carbon, preferably below 0.2% carbon. The fusion rate is surprisingly low, as tests have demonstrated.

DETAILED DESCRIPTION OF THE INVENTION

Figure 1:
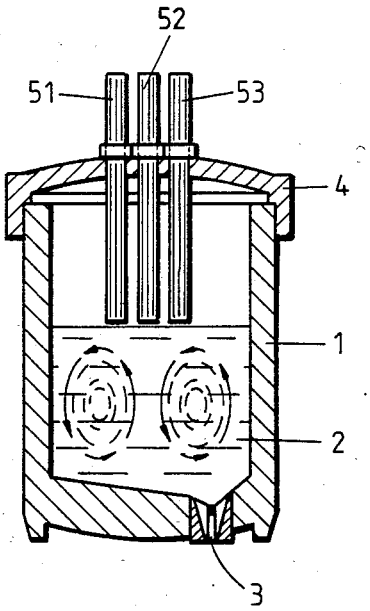
FIG. 1 illustrates diagrammatically a ladle aftertreatment apparatus according to the invention.

Referring to FIG. 1, a ladle aftertreatment apparatus consists of a cylindrical ladle 1 containing liquid metal 2. The metal melt is stirred via a floor-level blowing brick 3. The ladle 1 is closed by means of a cover 4, through which three electrodes 51, 52 and 53 are guided. The electrode tips extend near to the surface of the metal melt and there heat the metal melt via the electric arc. According to the invention, the electrodes consist of metal castings, preferably of continuous-casting billets or continuous-casting round stock having a composition corresponding to the analysis fo the metal melt.

It will be appreciated that the instant specification and claims are set forth by way of illustration and not limitation, and that various modifications and changes may be made without departing from the spirit and scope of the present invention.

What is claimed is:

1. An apparatus for refining molten steels, after smelting in a separate vessel, comprising: a cylindrical ladle for receiving molten steel, and at least one non-consumable electrode passing through said cover for heating the molten steel via electric arcs, wherein the at least one electrode consists of a continuously cast steel billet having a composition corresponding to the analysis of the metal melt, the apparatus intended for aftertreatment of premelted metals.

2. An apparatus for refining molten steels with carbon contents below 0.02% or steels with narrow carbon tolerances, after smelting in a separate vessel, comprising: a cylindrical ladle for receiving molten steel, and at least one non-consumable electrode passing through said cover for heating the molten steel via electric arcs, wherein the at least one electrode consists of a continuously cast steel billet having a composition corresponding to the analysis of the metal melt with a carbon content of less than 0.5%, the apparatus intended for aftertreatment of premelted metals.

3. A process for producing steels with carbon contents below 0.02% or steels with narrow carbon tolerances, comprising premelting steel in a smelting unit and subsequently alloying, rabbling and homogenizing the steel in an aftertreatment unit wherein the melt is heated in the aftertreatment via electric arcs between the melt and electrodes made of low-carbon steel whereby the predetermined carbon content in the smelting unit is set and is maintained in the aftertreatment unit.

4. The apparatus according to claim 1, wherein the electrode has a square cross-section with a side length of 120 to 200 mm.

5. The apparatus according to claim 1, wherein the electrode has a circular cross-section with a diameter of 120 to 200 mm.

* * * * *